US008869475B2

(12) United States Patent
Lopes

(10) Patent No.: US 8,869,475 B2
(45) Date of Patent: Oct. 28, 2014

(54) SELF-ADJUSTING FIRESTOPPING SLEEVE APPARATUS WITH FLEXIBLY RESILLIENT SUPPLEMENTAL CONSTRICTION MEANS

(71) Applicant: Specified Technologies Inc., Somerville, NJ (US)

(72) Inventor: Julio Lopes, Dunellen, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 13/987,950

(22) Filed: Sep. 18, 2013

(65) Prior Publication Data

US 2014/0020915 A1 Jan. 23, 2014

Related U.S. Application Data

(62) Division of application No. 12/924,258, filed on Sep. 23, 2010.

(60) Provisional application No. 61/279,524, filed on Oct. 22, 2009.

(51) Int. Cl.

| | |
|---|---|
| ***E04H 9/00*** | (2006.01) |
| ***E04C 2/52*** | (2006.01) |
| ***E04B 2/00*** | (2006.01) |
| ***E04B 1/94*** | (2006.01) |
| ***A62C 3/16*** | (2006.01) |

(52) U.S. Cl.

CPC ..... *A62C 3/16* (2013.01)
USPC ..... 52/220.8; 52/1; 52/232; 52/317; 52/220.1; 52/287.1

(58) Field of Classification Search

CPC ..... F16L 5/04; F16L 11/125; F16L 59/145; F16L 55/1026; F16L 55/17; F16L 57/04; H02G 3/0412; A62C 2/065; A62C 3/16; A62C 2/06; A62C 35/02; G02B 6/443; E04F 17/08

USPC ..... 52/1, 232, 220.8, 220.1, 287.1, 317

See application file for complete search history.

(56) References Cited

U.S. PATENT DOCUMENTS

| | | | | |
|---|---|---|---|---|
| 2,441,565 | A | 10/1908 | Imamura et al. | |
| 2,542,583 | A | 2/1951 | Shea, Jr. | |
| 2,713,284 | A | 7/1955 | Bedford, Jr. | |
| 2,723,226 | A | 1/1956 | Bvattberg | |
| 3,451,696 | A | 6/1969 | Hagelia et al. | |
| 3,601,863 | A * | 8/1971 | Dorsey | 24/16 PB |
| 3,668,740 | A * | 6/1972 | Pearson | 24/16 PB |
| 3,823,255 | A | 7/1974 | La Gase et al. | |
| 3,976,825 | A | 8/1976 | Anderberg | |

(Continued)

FOREIGN PATENT DOCUMENTS

DE 3624407 A1 * 2/1988 ..... H02G 3/22

*Primary Examiner* — Phi A
*Assistant Examiner* — Omar Hijaz
(74) *Attorney, Agent, or Firm* — Sperry, Zoda & Kane

(57) ABSTRACT

A firestopping sleeve positionable usually in walls which is self-adjusting and includes a sleeve defining an access corridor extending longitudinally therewithin with at least one firestopping pad positioned therein. The pad defines an access corridor extending therethrough for receiving wall penetrating cables which are firestopped therearound by the pad. A supplemental construction band is positioned extending around the pad for enhancing firestopping adjacent the penetrating wire for facilitating preventing the flow of heat, smoke or fire therepast.

9 Claims, 5 Drawing Sheets

(56) References Cited

U.S. PATENT DOCUMENTS

| | | | | | |
|---|---|---|---|---|---|
| 4,086,736 | A | | 5/1978 | Landrigan | |
| 4,093,818 | A | | 6/1978 | Thwaites et al. | |
| 4,141,322 | A | * | 2/1979 | Evans et al. | 119/654 |
| 4,189,619 | A | | 2/1980 | Pedlow | |
| 4,237,667 | A | | 12/1980 | Pallucci et al. | |
| 4,273,821 | A | | 6/1981 | Pedlow | |
| 4,276,332 | A | | 6/1981 | Castle | |
| 4,302,917 | A | | 12/1981 | Fermuik et al. | |
| 4,307,546 | A | | 12/1981 | Dolder | |
| 4,347,998 | A | | 9/1982 | Loree | |
| 4,424,867 | A | | 1/1984 | Mallow | |
| 4,513,173 | A | | 4/1985 | Merry | |
| 4,548,853 | A | | 10/1985 | Bryan | |
| 4,559,745 | A | | 12/1985 | Wexler | |
| 4,639,825 | A | * | 1/1987 | Breidegam | 361/212 |
| 4,676,025 | A | | 6/1987 | Mattscheck et al. | |
| 4,758,003 | A | | 7/1988 | Goldstein et al. | |
| 4,796,401 | A | | 1/1989 | Wexler | |
| 4,986,709 | A | | 1/1991 | Hachtel et al. | |
| 5,067,676 | A | | 11/1991 | Beele | |
| 5,091,608 | A | | 2/1992 | Gunther | |
| 5,169,115 | A | | 12/1992 | Chung Hsiang | |
| 5,174,077 | A | | 12/1992 | Murota | |
| 5,344,106 | A | | 9/1994 | Beele | |
| 5,413,262 | A | * | 5/1995 | Dewire et al. | 224/675 |
| 5,447,400 | A | | 9/1995 | Seymour | |
| 5,456,050 | A | | 10/1995 | Ward | |
| 5,560,397 | A | * | 10/1996 | Miller et al. | 138/110 |
| 5,581,850 | A | * | 12/1996 | Acker | 24/16 PB |
| 5,594,202 | A | | 1/1997 | Tobias | |
| 5,634,304 | A | | 6/1997 | Sakno | |
| 5,729,938 | A | | 3/1998 | Tobias | |
| 6,158,476 | A | | 12/2000 | Sjütun | |
| 6,336,297 | B1 | | 1/2002 | Cornwall | |
| 6,405,502 | B1 | | 6/2002 | Cornwall | |
| 6,470,635 | B2 | | 10/2002 | Cornwall | |
| 6,477,813 | B2 | | 11/2002 | Andresen | |
| 6,523,229 | B2 | * | 2/2003 | Severson | 24/16 PB |
| 6,615,860 | B2 | | 9/2003 | Didone et al. | |
| 6,711,329 | B2 | | 3/2004 | Zelesnik | |
| 6,718,100 | B2 | | 4/2004 | Morris | |
| 6,732,481 | B2 | | 5/2004 | Stahl, Sr. | |
| 6,831,118 | B2 | | 12/2004 | Münzenberger | |
| 6,862,852 | B1 | | 3/2005 | Beele | |
| 6,876,797 | B2 | | 4/2005 | Morris | |
| 6,948,567 | B1 | | 9/2005 | Cyphers et al. | |
| 6,969,799 | B2 | | 11/2005 | Snyder | |
| 7,018,699 | B2 | | 3/2006 | Dykhoff | |
| 7,297,009 | B1 | | 11/2007 | Gormerley et al. | |
| 7,465,888 | B2 | | 12/2008 | Fischer et al. | |
| 7,503,956 | B2 | | 3/2009 | Thaler | |
| 7,523,590 | B2 | | 4/2009 | Stahl, Sr. | |
| 7,581,362 | B2 | | 9/2009 | Vaughan | |
| 8,069,623 | B2 | * | 12/2011 | Colwell et al. | 52/220.8 |
| 8,397,452 | B2 | * | 3/2013 | Stahl et al. | 52/232 |
| 2006/0000165 | A1 | * | 1/2006 | Robertson | 52/232 |
| 2006/0070320 | A1 | * | 4/2006 | Otto | 52/232 |
| 2006/0138251 | A1 | * | 6/2006 | Stahl | 239/309 |
| 2008/0128998 | A1 | | 6/2008 | Klein et al. | |
| 2009/0126989 | A1 | * | 5/2009 | Ford et al. | 174/491 |

* cited by examiner

SELF-ADJUSTING FIRESTOPPING SLEEVE APPARATUS WITH FLEXIBLY RESILLIENT SUPPLEMENTAL CONSTRICTION MEANS

The present utility application is a divisional application of and hereby formally claims priority of U.S. Utility patent application Ser. No. 12/924,258 filed Sep. 23, 2010 on "SELF-ADJUSTING FIRESTOPPING SLEEVE WITH FLEXIBLY RESILIENT SUPPLEMENTARY CONSTRICTION MEANS" filed by the same inventor as listed herein, namely, Julio Lopes, and assigned to the same assignee, namely, Specified Technologies, Inc. of Somerville N.J.; said referenced divisional application being hereby formally incorporated by reference as an integral part of the present application for all purposes.

The present utility application also hereby formally claims priority of U.S. Provisional Patent application No. 61/279,524 filed Oct. 22, 2009 on "SELF-ADJUSTING FIRESTOPPING SLEEVE WITH FLEXIBLY RESILIENT SUPPLEMENTARY CONSTRICTION MEANS" filed by the same inventor as listed herein, namely, Julio Lopes, and assigned to the same assignee, namely, Specified Technologies, Inc. of Somerville N.J.; said referenced provisional application being hereby formally incorporated by reference as an integral part of the present application for all purposes. The provisional application identified above was pending at the time of filing of the divisional parent application referenced hereabove.

BACKGROUND OF THE INVENTION

1. Field of the Invention

The present invention deals with the field of firestopping appliances positionable within an aperture located within a wall for firestop sealing around cables, wires or other longitudinal members which would otherwise be required to extend through the wall area. Such firestopping fixtures include various types of sealing inserts within the outer shell of the firestopping member, and the present invention provides a significant improvement in the design of such inserts.

Normally such a firestopping sleeve includes an outer shell defining an opening extending longitudinally therethrough with a sealing insert positioned therein for sealing between the interior wall of the outer shell which defines the longitudinal opening, and the outer surface of the cables that extend therethrough. The present invention provides a means for enhancing engagement of the firestopping seal both with respect to the interior walls of the outer shell, and also enhancing sealing thereof with respect to the cables extending therethrough for preventing the flow of fire, smoke or heat through the wall in the area localized adjacent to the wall-penetrating cables.

2. Description of the Prior Art

Many patents have been designed for the purpose of providing a seal around cables or wires extending through a structural panel such as a wall, floor or ceiling surface and enhancing sealing immediately adjacent to said cables such as shown in U.S. Pat. No. 2,542,583 patented Feb. 20, 1951 to W. T. Shea, Jr. on a "Cable-Sealing Fitting"; and U.S. Pat. No. 2,713,284 patented Jul. 19, 1955 to W. A. Bedford, Jr. on a "Spaced Panel Fastening Device"; and U.S. Pat. No. 2,732,226 patented Jan. 24, 1956 to N. Brattberg on a "Pressure-Tight Packing Assembly For Conductors Passing Through A Wall"; and U.S. Pat. No. 3,451,696 patented Jun. 24, 1969 to E. G. Hagelin et al on a "Method For Sealing Joints and the Like"; and U.S. Pat. No. 3,823,255 patented Jul. 9, 1974 to F. E. La Gase et al on a "Flame And Radiation Resistant Cable" and assigned to Cyprus Mines Corporation; and U.S. Pat. No. 3,976,825 patented Aug. 24, 1976 to H. Anderberg on a "Lead-Through For Electric Cables And The Like; and U.S. Pat. No. 4,086,736 patented May 2, 1978 to L. P. Landrigan and assigned to Daniel International Corporation on "Fire and Liquid Seals For Pipes and Conduits and Method of Forming Same"; and U.S. Pat. No. 4,093,818 patented Jun. 6, 1978 to P. J. Thwaites et al and assigned to Dufaylite Developments Limited on "Fire-Protective Cellular Service Ducting"; and U.S. Pat. No. 4,189,619 patented Feb. 19, 1980 to J. W. Pedlow on a "Fire Protective Mastic and Fire Stop"; and U.S. Pat. No. 4,237,667 patented Dec. 9, 1980 to J. N. Pallucci et al and assigned to Tech-Sil, Inc. on a "Method and Apparatus for Installing Gel Material in Architectural Barrier Breaches"; and U.S. Pat. No. 4,273,821 patented Jun. 16, 1981 to J. W. Pedlow on "Fire Protective Tape"; and U.S. Pat. No. 4,276,332 patented Jun. 30, 1981 to G. K. Castle on a "Fire Proof Cable Tray Enclosure"; and U.S. Pat. No. 4,302,917 patented Dec. 1, 1981 to L. A. Fermvik et al and assigned to Telefonaktiebolaget L M Ericsson on a "Method and Means for Fire-Sealing a Penetration For A Conduit"; and U.S. Pat. No. 4,307,546 patented Dec. 29, 1981 to R. Dolder and assigned to Geberit AG on "Fire Retardant Partitioning For Openings For Plastic Pipe Lines"; and U.S. Pat. No. 4,347,998 patented Sep. 7, 1982 to T. J. Loree and assigned to The Boeing Company on a "Multiple Wire Bundle Support Assembly"; and U.S. Pat. No. 4,424,867 patented Jan. 10, 1984 to W. A. Mallow and assigned to Fiberglas Canada Inc. on "Heat Hardening Sealant-Gel For Flexible Couplings"; and U.S. Pat. No. 4,513,173 patented Apr. 23, 1985 to R. P. Merry and assigned to Minnesota Mining and Manufacturing Company on "Intumescent Fire Protective Sheaths"; and U.S. Pat. No. 4,548,853 patented Oct. 22, 1985 to H. H. Bryan on a "Closure For A Surface Opening Having An Object Passing Therethrough and Method of Forming the Closure"; and U.S. Pat. No. 4,559,745 patented Dec. 24, 1985 to J. B. Wexler and assigned to Fire Research Pty Limited on "Devices For The Fire Stopping of Plastic Pipes"; and U.S. Pat. No. 4,676,025 patented Jun. 30, 1987 to D. Mattscheck et al and assigned to Schlegel Corporation on a "Remotely Activatable Seal"; and U.S. Pat. No. 4,758,003 patented Jul. 19, 1988 to M. K. Goldstein et al and assigned to Quantum Group, Inc. on a "Method and Apparatus For Changing Physical and Chemical Properties Of Materials"; and U.S. Pat. No. 4,796,401 patented Jan. 10, 1989 to J. B. Wexler and assigned to Fire Research Pty., Limited on a "Composite Fire Stop Device"; and U.S. Pat. No. 4,986,709 patented Jan. 22, 1991 to H. Hachtel et al and assigned to Hilti Aktiengesellschaft on a "Fastening Element Assembly"; and U.S. Pat. No. 5,067,676 patented Nov. 26, 1991 to Johannes A. Beele assigned to CSD International B.V. on a "System For The Prevention of Fire, Water or Flue Gas and the Like From Propagating Along Cables"; and U.S. Pat. No. 5,091,608 patented Feb. 25, 1992 to G. John and assigned to Minnesota Mining and Manufacturing Company on a "Flame Retardant Splicing System"; and U.S. Pat. No. 5,169,115 patented Dec. 8, 1992 to Chung hsiang on an "Adhesive and Fastener-Free Footing Pad"; and U.S. Pat. No. 5,174,077 patented Dec. 29, 1992 to G. Murota and assigned to The Furukawa on a "Fire Protecting Structure Of Channel Portion Of Plastic Piping In A Fire Partition"; and U.S. Pat. No. 5,344,106 patented Sep. 6, 1994 to J. A. Beele and assigned to Beele Engineering B.V. on a "Fire Resisting Cable System"; and U.S. Pat. No. 5,477,400 patented Sep. 5, 1995 to H E. Seymour and assigned to Xantech Corporation on a "Wall Penetrator Fitting"; and U.S. Pat. No. 5,456,050 patented Oct. 10, 1995 to T. T. Ward and assigned to Construction Consultants & Contractors, Inc. on a "System to Prevent Spread Of Fire and Smoke Through Wall-Breaching Utility Holes"; and U.S. Pat. No. 5,594,202 patented Jan. 14, 1997 to M. A. Tobias on a "Split Sleeve System"; and U.S. Pat. No. 5,634,304 patented Jun. 3, 1997 to M. P. Sakno on "Water Impervious Intumescent Firestop Collapsing Conduit"; and U.S. Pat. No. 5,729,938 patented Mar. 24, 1998 to M. A. Tobias on a "Wall Penetrator Sleeve System"; and U.S. Pat. No. 6,158,476 patented Dec. 12, 2000 to K. Sjotun and assigned to Trelleborg Viking AS on a "Tune or Hose Capable of Withstanding Extreme Heat Flux Densities"; and U.S. Pat. No. 6,336,297 patented Jan. 8, 2002 to K. R. Cornwall on a "Self Sealing Firestop Coupling Assembly"; and U.S. Pat. No. 6,405,502 patented Jun. 18, 2002 to K. R. Cornwall on a "Firestop Assembly Comprising Intumescent Material Within A Metal Extension Mounted On The Inner Surface Of A Plastic Coupling"; and U.S. Pat. No. 6,470,635 patented Oct. 29, 2002 to K. R. Cornwall on a "Coupling Assembly With Intumescent Material"; and U.S. Pat. No. 6,477,813 patented Nov. 12, 2002 to A. Andresen and assigned to Hilti Aktiengesellchaft on a "Fire Protection Sleeve"; and U.S. Pat. No. 6,615,860 patented Sep. 9, 2003 to B. M. Didone et al and assigned to Royal Group Technologies Limited on a "Fire Block Conduit Coupler"; and U.S. Pat. No. 6,711,329 patented Mar. 23, 2004 to D. J. Zelesnik and assigned to Parker-Hannifin Corporation on a "Flame Retardant Tubing Bundle"; and U.S. Pat. No. 6,718,100 patented Apr. 6, 2004 to D. D. Morris and assigned to Milliken & Company on a "Fire Resistant Conduit Insert For Optical Fiber Cable"; and U.S. Pat. No. 6,732,481 patented May 11, 2004 to J. P. Stahl, Sr. and assigned to Specified Technologies Inc. on an "Intumescent Firestopping Apparatus"; and U.S. Pat. No. 6,831,118 patented Dec. 14, 2004 to H. Munzenberger and assigned to Hilto Aktiengesellschaft on a "Flexible Fire Protection Plate and Its Use For The Fire Protection Of Openings In Walls, Floors and Ceilings"; and U.S. Pat. No. 6,862,852 patented Mar. 8, 2005 to J. A. Beele and assigned to Beele Engineering, B.V. on a "Sealing System and Gasket Therefor"; and U.S. Pat. No. 6,876,797 patented Apr. 5, 2005 to D. D. Morris and assigned to Milliken & Company on a "Fire Resistant Conduit Insert For Optical Fiber Cable"; and U.S. Pat. No. 6,948,567 patented Sep. 27, 2005 to D. C. Cyphers et al and assigned to Skyward, Ltd. on a "Passive Fire Protection Device"; and U.S. Pat. No. 6,969,799 patented Nov. 29, 2005 to D. L. Snyder and assigned to SGC Technologies, L.L.C. on a "Poke Through"; and U.S. Pat. No. 7,018,699 patented Mar. 28, 2006 to M. G. Dykoff and assigned to 3M Innovative Properties Company on a "Fire Stop Article"; and U.S. Pat. No. 7,297,009 patented Nov. 20, 2007 to H. J. Gormerley on a "Protective Plate Kit For Cables and the Like"; and U.S. Pat. No. 7,441,565 patented Oct. 28, 2008 to M. Imamura et al and assigned to Tosetz Co., Ltd. on a "Fire Protective Zone Penetrating Member and Injection-Molding Method For The Same"; and U.S. Pat. No. 7,465,888 patented Dec. 16, 2008 to M. Fischer et al and assigned to Hilti Aktiengesellshaft on a "Cast-In Element For Forming A Leadthrough For Conduits"; and U.S. Pat. No. 7,503,956 patented Mar. 17, 2009 to D. M. Thaler and assigned to Caterpillar Inc. on an "Exhaust Treatment Device With Adjustable Retention Collar"; and U.S. Pat. No. 7,523,590 patented Apr. 28, 2009 to J. P. Stahl, Sr. and assigned to Specified Technologies Inc. on an "Intumescent Firestopping Apparatus and Method"; and U.S. Pat. No. 7,581,362 patented Sep. 1, 2009 to J. A. Vaughan and assigned to METIS Holdings on a "Conduit With Adjustable Length and Fire Collar"; and United States Patent Publication No. 2008/0128998 published Jun. 5, 2008 to M. Klein et al and assigned to Hilti Aktiengesellshaft on a "Leadthrough and a Sealing Element For The Leadthrough".

SUMMARY OF THE INVENTION

The present invention provides a firestopping sleeve apparatus which is self-adjusting and has a flexibly resilient supplemental constriction means for receiving penetrating members such as wires or cables extending therethrough for facilitating firestopping therearound. The apparatus includes a sleeve adapted to be positioned passing through a construction barrier wherein the sleeve defines an access corridor extending longitudinally therethrough for providing access through the construction barrier for positioning penetrating members. The sleeve includes a first end defining a first opening in fluid flow communication with respect to the access corridor. The sleeve also includes a second end defining a second opening in fluid flow communication with respect to the access corridor and positioned spatially disposed from the first end.

The apparatus further includes a first firestopping pad located within the access corridor and extending at least partially therealong. A second firestopping pad is also defined located within the access corridor and extending at least partially therealong to define a confinement area between the first firestopping pad and the second firestopping pad within the access corridor for the purpose of sealing around a penetrating member passing through the confinement area responsive to exposure thereof to heat. At least one of the firestopping pads has at least a portion thereof that is movable toward the other of the firestopping pads for the purpose of facilitating firestop sealing therebetween. The apparatus further includes a supplemental constriction means extending around the first firestopping pad and the second firestopping pad for biasing thereof toward a penetrating member extending through the confinement area to facilitate firestop sealing therearound.

The supplemental constriction means of the sleeve apparatus can comprise a banding member which is preferably of rubber material or other flexibly resilient elastic-type material. The amount of constriction in certain embodiments can be adjusted by various adjustment means such as the inclusion of an adjustment portion to extend outward through an adjustment slot defined in the sleeve. A plurality of belt loops can be defined on the external surface of the firestopping pad for maintaining engagement thereof by the supplemental constriction band extending through the individual belt loops.

Other means are disclosed for providing the supplemental constriction such as the use of constricting pillows and a spiral banding means.

It is an object of the self-adjusting firestopping sleeve with flexibly resilient supplemental constriction means of the present invention to enhance sealing around cables extending through structural panels such as walls, floors or ceilings in residential and commercial buildings.

It is an object of the self-adjusting firestopping sleeve with flexibly resilient supplemental constriction means of the present invention to minimize damage to wires and cables extending through structural panels such as walls, ceilings or floors by minimizing abrasion against the cables during installation of firestopping fixtures therearound.

It is an object of the self-adjusting firestopping sleeve with flexibly resilient supplemental constriction means of the present invention to utilize a flexibly resilient sealing band to enhance engaging abutment between a sealing means and penetrating cables extending through a firestopping sleeve positioned within a wall, ceiling or floor.

It is an object of the self-adjusting firestopping sleeve with flexibly resilient supplemental constriction means of the present invention to utilize a flexibly resilient sealing band to maintain abutting contact between a ceiling means of a firestopping fixture and cables extending therethrough.

It is an object of the self-adjusting firestopping sleeve with flexibly resilient supplemental constriction means of the present invention to allow maintenance of abutting contact between a sealing insert positioned within a firestopping sleeve and the interior wall of the longitudinally extending opening defined therewithin while maintaining sealing engagement with the cables positioned therewithin.

It is an object of the self-adjusting firestopping sleeve with flexibly resilient supplemental constriction means of the present invention to provide a means for external adjustment of the amount of constriction provided upon a sealing insert positioned within a firestopping sleeve.

It is an object of the self-adjusting firestopping sleeve with flexibly resilient supplemental constriction means of the present invention to minimize air leakage between sealing pads in the interior walls of the outer shell of a self-adjusting firestopping sleeve when configured rectangularly with arched and opposed sealing pads.

It is an object of the self-adjusting firestopping sleeve with flexibly resilient supplemental constriction means of the present invention to increase the inwardly radially directed flexibly resilience of a sealing insert positioned within the outer shell of a firestopping device.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 3:
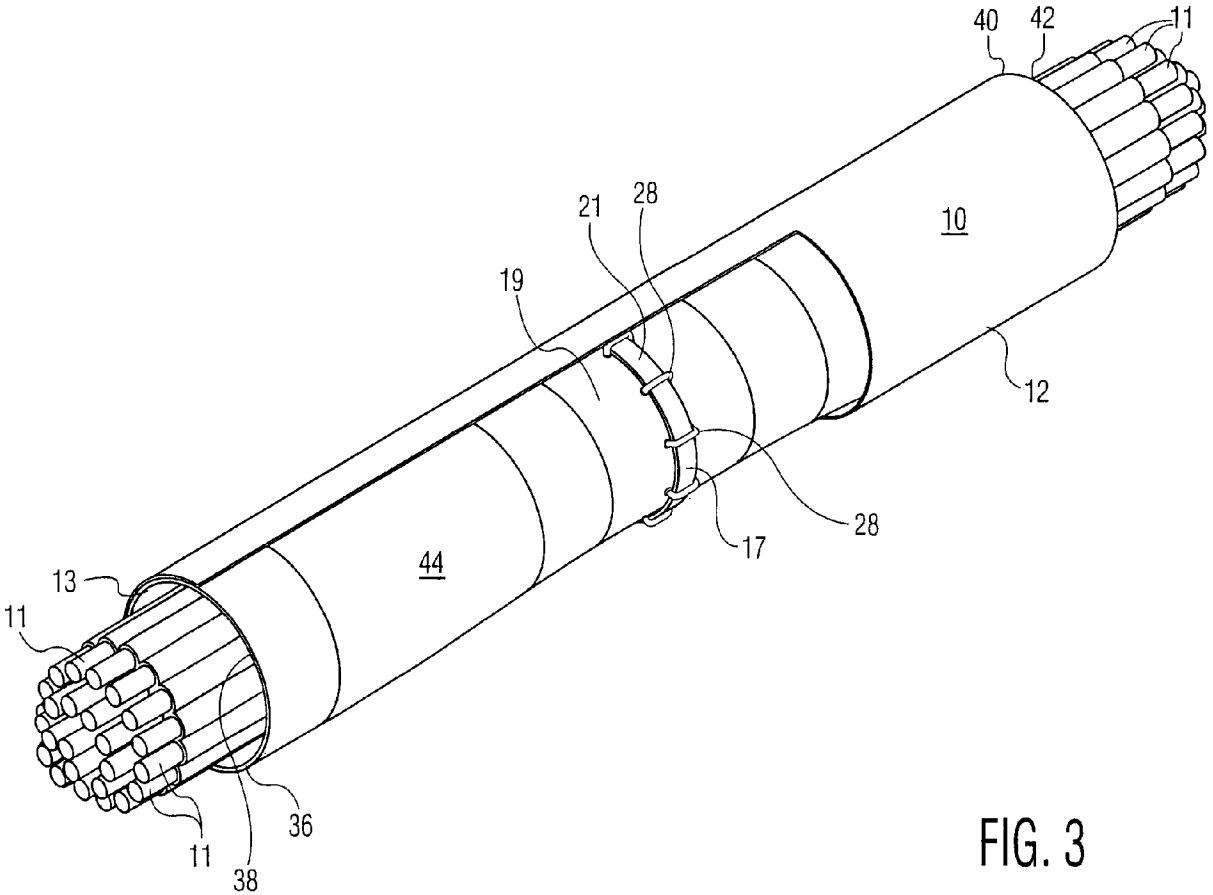
FIG. 3 is a further alternative illustration of the present invention utilizing a firestopping sleeve having an outer shell which is tubular and includes an outer banding means extending through a plurality of loops for retaining the outer banding which are defined in the outer surface of the sealing insert for enhancing contact therewith and facilitating constriction thereof.
Figure 4:
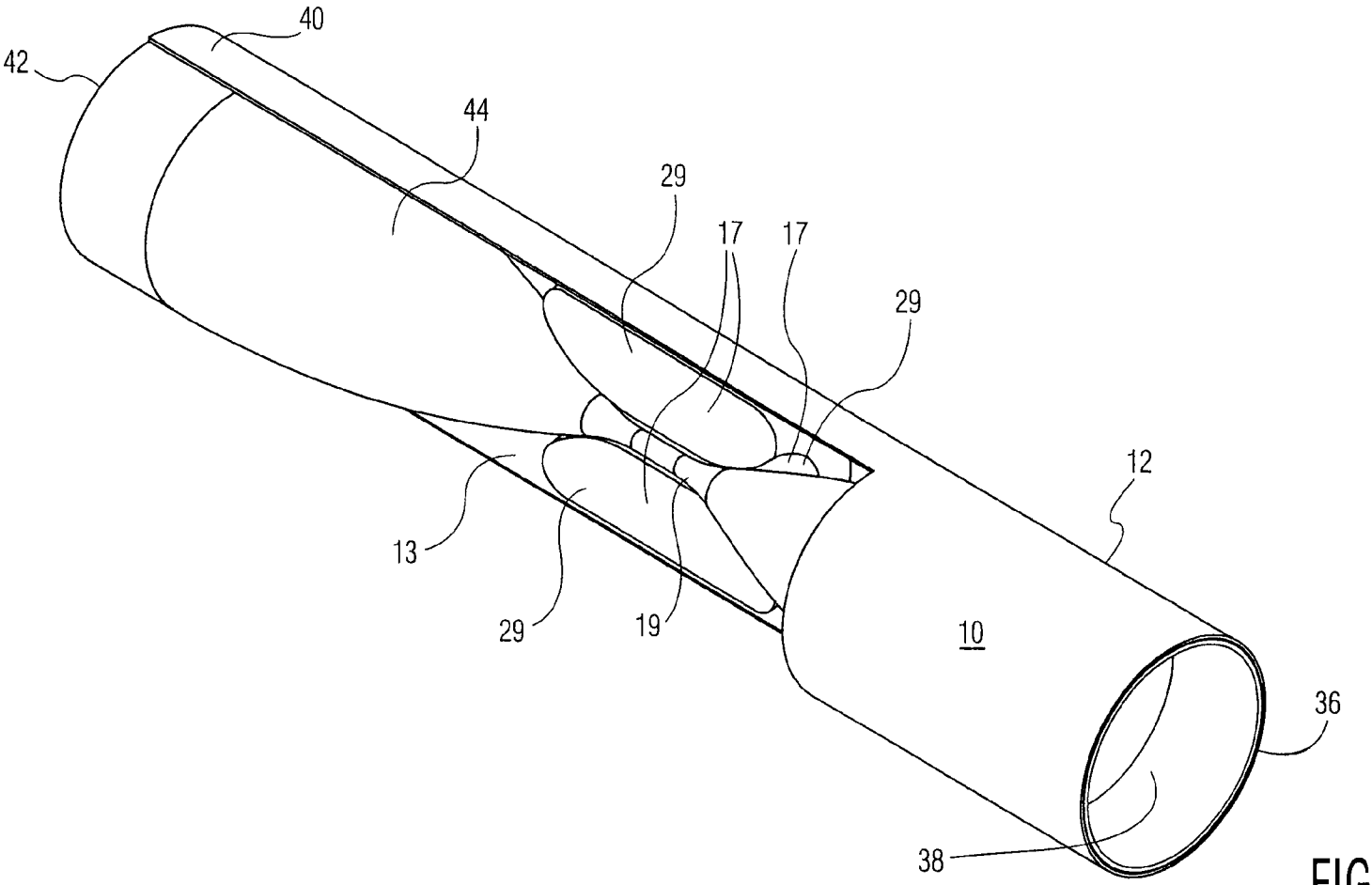
FIG. 4 is an illustration of a further embodiment of the present invention utilizing a plurality of constriction pillows positioned within the longitudinal opening of the outer shell of the firestopping sleeve for providing constriction to a portion of the sealing means for enhancing abutment and contact thereof for sealing against cables pressing therethrough.
Figure 5:
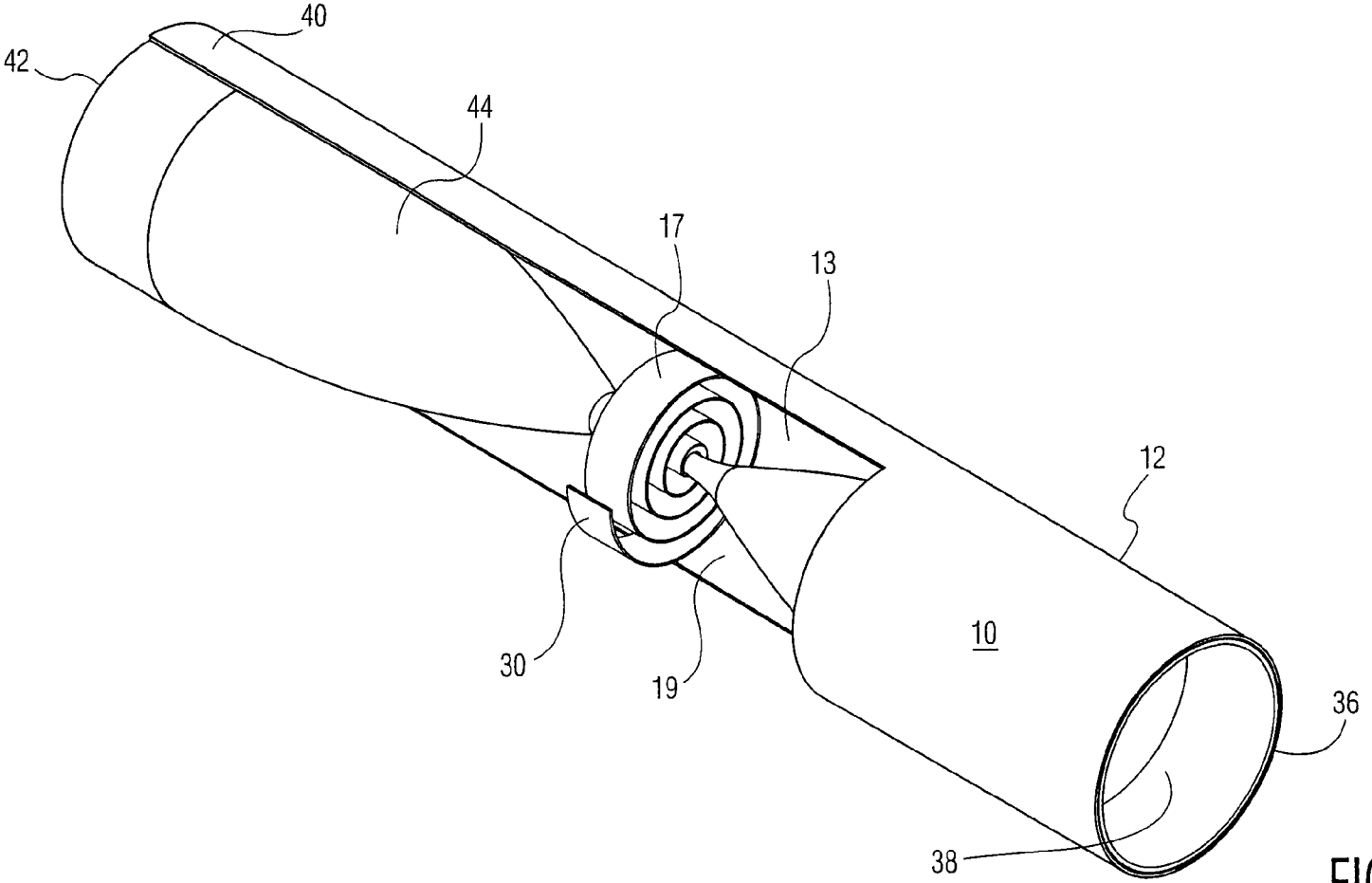
FIG. 5 is a further alternative illustration of an embodiment of the present invention utilizing an outer banding means configured as a spiral band or spring in engagement with the interior wall of the outer shell of the firestopping sleeve, as well as being in constricting abutment with respect to the sealing means extending through the longitudinal opening defined therein.

The present invention provides a self-adjusting firestopping sleeve 10 which includes an outer shell 12 which can be either tubular or rectangular. Two different embodiments with rectangular or square cross-sections are shown in FIGS. 1 and 2, and further examples showing tubular cross-sectional embodiments are shown in FIGS. 3, 4 and 5.

Each of these designs is for the purpose of sealing around wires or cables 11 or other similar penetrating members which are positioned extending through a construction panel such as a wall, floor or ceiling having an aperture therein for allow the penetrating members to pass therethrough for various reasons. The sleeve 10 will define an access corridor 13 defined extending completely longitudinally through the outer shell 12 thereof. Each sleeve 10 includes interior sleeve wall means which defines the outermost boundaries of the access corridor 13. In the rectangular or square version shown in FIGS. 1 and 2 the sleeve will define a first lateral sleeve wall 14 and a second lateral sleeve wall 15 against which the edges of the first and second firestopping pads 32 and 34 will preferably abut.

A firestopping pad 44 is required to be positioned within the access corridor 13 and can be of various configurations in order to facilitate sealing around cables 11 or other penetrating members positioned extending therethrough in order to achieve firestop sealing between the sleeve interior walls 14 and 15 and the cables 11. This firestop sealing pad 44 is for the purpose of preventing the flow of fire, smoke or heat adjacent to penetrating members extending through any structural panel within a commercial or residential building such as when located within a wall, floor or ceiling panel that is fire rated.

Figure 1:
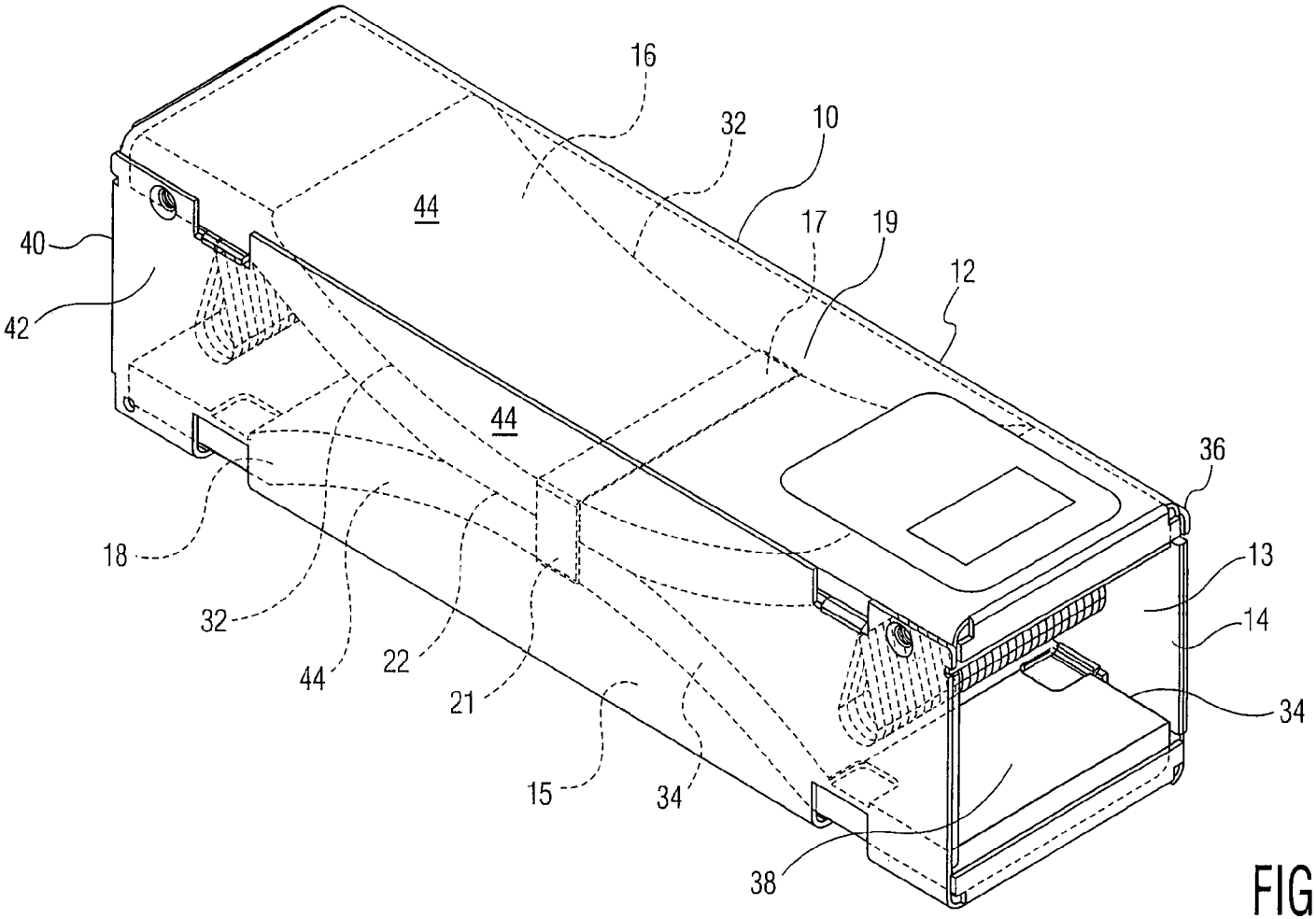
FIG. 1 is a perspective illustration of an embodiment of a self-adjusting firestopping sleeve made in accordance with the present invention utilizing a flexibly resilient outer banding means formed of a flexibly resilient material for enhancing the constriction of opposed sealing pads in engagement with cables extending therebetween within the outer shell of the firestopping sleeve wherein the shell is generally rectangularly configured.
Figure 2:
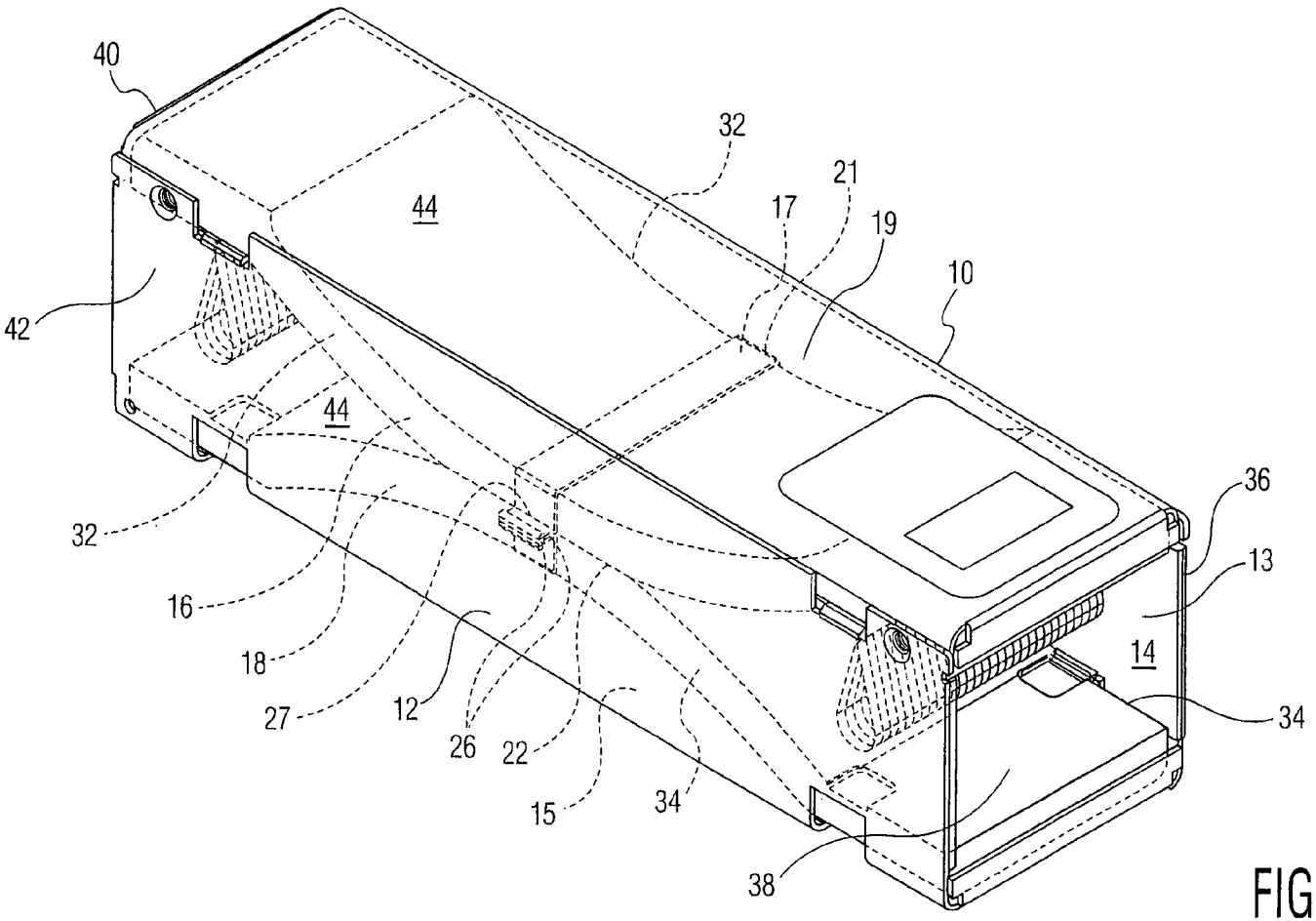
FIG. 2 is an alternative illustration to the embodiment showing FIG. 1 with the inclusion of an externally accessible adjustment mechanism for varying the magnitude of constriction forces exerted upon the two opposed pads.

In one of the preferred constructions of the present invention, as shown in FIGS. 1 and 2, the sleeve 10 will be generally rectangular in shape and will have a square or slightly rectangular cross-section. These configurations will preferably include a first firestopping pad means 16 which is preferably arched and positioned within the upper area of the access corridor 13 in the outer shell 12. A second firestopping pad 18 will also preferably be arched such and will be positioned within the lower section of the longitudinal opening 13. In this manner, the first firestopping pad 16 and the second firestopping pad 18 will be preferably slightly arched in a convex manner facing one another, and will be opposed from one another such as to be gently biased into abutment with respect to one another along a pad abutment seam 20 defined therebetween which also defined the confinement area 19 for receiving cables 11 extending longitudinally therethrough. This confinement area 19 at the pad abutment seam 20 will provide the location for placement of cables 11 extending through the sleeve 10 while also maintaining firestopping therearound. It should be appreciated that both of the two pads 16 and 18 need not be arched. Only one of these pads need to be arched or otherwise urged toward the other pad in order to form the confinement area 19 such that it is capable of sealing against penetrating members 11.

There is a limited amount of inherent flexible resilience in the arched configuration of the first and second firestopping pads 16 and 18 since they are usually formed of a flexibly resilient foam material and will often include an intumescent component therewithin. However, these pads can be of any commonly available material which includes a firestopping component and the magnitude of the inherent flexible resilience thereof can vary greatly. The flexible resilience of the pads themselves provides some amount of force for exerting the force needed for firestopping sealing about cables 11 which pass through the confinement area 19 defined therebetween. However, the present invention provides an enhancement for the inherent flexible resilience of the first and second firestopping pads 16 and 18 by providing a flexibly resilient supplemental constriction means 17 such as a banding means 21 which extends around both opposed pads and enhances abutting sealing contact thereof with respect to the cables 11 passing therebetween for sealing thereadjacent.

In the embodiment shown in FIGS. 1 and 2, the construction of the banding means 21 comprises a single flexible resilient member preferably of rubber or another elastic material which extends around the first firestopping pad means 16 and the second firestopping pad means 18 in such a manner as to compress radially inwardly to seal against a penetrating member such as a cable or wire 11 positioned within the confinement area 19 located between the two firestopping pads along the pad adjustment seam 20 defined therebetween.

The outer banding means 21 can also possibly include an adjustment capability. This adjustment capability can be provided by various means depending upon the specific construction. For example, banding means 21 can be manufactured with various different magnitudes of flexible resilience or be of various sizes to provide an adjustability feature in the total magnitude of flexibly resilient supplemental constriction when initially installed. Alternatively, the band 21 can have an adjustment portion or section 26 as shown in FIG. 2 which extends outwardly through an adjustment slot 27 defined in the outer shell 12 of sleeve 10 which can be pulled outwardly by installation personnel to increase the amount of constriction. The amount of constriction can be reduced by a user merely by reaching within the sleeve 10 and expanding the pad slightly to pull the adjustment section 26 to a less extended position. The ability to adjust the amount of supplementary flexibly resilient constriction force on the pad configuration shown in FIG. 2 is one of the important characteristics of the present invention.

The basic concept of providing a flexibly resilient supplemental constriction means 17 is usable with the apparatus of the present invention when using designs wherein the firestopping sleeve itself is of a circular, oval or round configuration as shown in FIGS. 3, 4, and 5. FIG. 3 shows a configuration wherein a plurality of belting loops 28 are included positioned on the external surface of the firestopping sealing pad means 44 through which the outer banding means 21 can extend to maintain contact thereof with respect to the outer surface of the sealing means 15 for enhancing sealing. This belted configuration also maintains the longitudinal positioning of the band 21 with respect to the firestopping pad 44 at the preferred position which is equidistantly spaced between the first opening 38 defined at the first end 36 of sleeve 10 and the second opening 42 defined at the second end 40 of sleeve 10. The first end 36 and the second end 38 are preferably defined at opposite ends of the sleeve 10 with the first opening 38 and the second opening 42 in full fluid flow communication with respect to the access corridor 13 defined in the interior of sleeve 10 extending between first end 36 and second end 38. In the central portion of the sleeve 10, the sealing means 15 will be constricted or biased radially inwardly somewhat by the positioning of the banding means 21 extending through the loop means 28 defined therewithin. This constriction will be localized to the central portion of firestopping pad 44, and as such, sealing abutment of the pad 44 will still be maintained with respect to the interior wall 14 of the outer shell 12 immediately adjacent to the first end 36 and second end 40 while inwardly biased constriction in the most central area is maintained. Thus, the portions of firestopping pad 44 closest to the first end 36 and the second end 40 will maintain sealing abutment contact with respect to the sleeve interior wall 14, while effective sealing around the cables 11 will be enhanced in the central portion thereof adjacent to the loop means 28 by the supplemental constriction means 17. This supplemental constriction will be provided by the flexible resilient banding means 21 extending through these belting loops 28 and constricting the central portion of the sealing means 15 firmly and yet gently with respect to the cables 11 or other penetrating members extending therethrough.

FIG. 4 shows another alternative configuration for the construction of the present invention which utilizes a plurality of constricting pillows 29 positioned centrally within the sleeve 12 between the sleeve interior wall 14 of the tubular outer shell 12, and the exterior surface of the firestopping pad 44. These constricting pillows 29 are preferably flexibly resilient in such a manner as to engage and compress the firestopping pad 44 into engagement with respect to the cables 11 extending through confinement area 19 in the localized area centrally positioned within the firestopping sleeve 10 adjacent pillows 29.

A further alternative configuration for the apparatus of the present invention is shown in FIG. 5 wherein the banding means 21 is formed in the shape of a spirally shaped band 30 which spirals from a position in abutting engagement with respect to the sleeve interior wall 14 inwardly radially around and toward the exterior surface of the firestopping pad 44 for constricting thereof in the localized area central position into abutment with a cable 11 or other penetrating member extending through confinement area 19 at a position within the sleeve 10 to provide a construction similar to that shown in FIG. 4, but utilizing a different means for forming the constriction, namely, the use of a spiral band 30 instead of a plurality of constriction pillows 29. This spiral band 30 can be formed of a more rigid flexibly resilient material in order to provide a spiral flat spring means in order to firmly engage the interior wall of sleeve 10 and the exterior surface of firestopping pad 44.

One of the important considerations of the apparatus of the present invention shown in FIGS. 1 and 2 is that when the firestopping sleeve 10 is utilized without any type of a flexibly resilient supplemental constriction band, the first firestopping pad means 16 and the second firestopping pad means 18 need to be of a lateral dimension slightly less than the laterally extending internal dimension between the first interior sleeve wall 14 and second interior sleeve wall 15. This dimensional restriction is necessary in order to prevent binding of the first firestopping pad outer edge surfaces 32 with respect to the first sleeve interior wall 14 and the second sleeve interior wall 15 in the upper portion of the sleeve as shown in FIG. 1. Similarly the second firestopping pad outer edge surfaces 34 will tend to bind against the first sleeve interior wall 14 and the second sleeve interior wall 15 unless the second firestopping pad 34 is sized slightly less than the distance between wall 14 and wall 15. Both the first firestopping pad 16 and the second firestopping pad 18 initially were each sized slightly less than the distance between the wall 14 and 15 to prevent binding thereagainst so that completely sealing around the penetrating members 11 in the confinement area 19 is fully achieved. It should be appreciated that binding between the outer edges of the two firestopping pads and the first and second sleeve interior walls 14 and 15 tend to restrict the ability of the pads to engage and seal against penetrating members positioned within the confinement area 19. Thus slightly undersizing the lateral dimension of the opposed arched firestopping pads 32 and 34 provides a small amount of clearance between the outer edge surfaces 32 and 34 of each of the first and second pads 16 and 18. These narrow openings provide more freedom for flexing movement of the pads 16 and 18 with respect to one another to enhance engagement with respect to the outer surfaces of cables 11 extending therebetween in the confinement area 19. However, this slight spacing between the outer edge surfaces 32 and 34 of the pads and the interior walls 14 and 15 of the sleeve 10, provide some leakage for air, smoke or heat to flow thereby which is clearly not desirable.

However, when used with the novel construction of the present invention, the firestopping pads are made wide enough to extend completely from the first sleeve interior wall 14 to the second sleeve interior wall 15. This construction is possible because the flexibly resilient supplemental constriction means 17 will be capable of overpowering any resistance to flexing of the pads 16 and 18 due to binding thereof with respect to the first sleeve interior wall 14 and the second interior wall 15. Therefore, the first and second firestopping pad means 16 and 18 can both be configured to be wider with the outer edge surfaces 32 and 34 thereof in abutting and sealing contact with respect to the sleeve interior walls 14 and 15, thus preventing the unwanted flow of any heat, smoke or fire thereby between these walls and the adjacent edges of the firestopping pads 16 and 18. The slight binding that may occur between the outer edge surfaces 32 and 34 and the sleeve interior walls 14 and 15 can be easily overcome by choosing a banding configuration having sufficient inwardly directed bias to compress the first and second firestopping pad means 16 and 18 against any penetrating members 11 positioned extending through confinement area 19. Thus, the use of the flexibly resilient supplemental constriction means 17 of the present invention significantly enhances sealing between the firestopping pads 16 and 18 and the cables 11, while also allowing enhanced securement between the outer edge surfaces 32 and 34 of the first and second firestopping pad means 16 and 18 the interior walls 14 and 15 thereadjacent. It should be appreciated that the lateral size of pads 32 and 34 could be configured to be greater than the distance between the first sleeve interior wall 14 and the second interior wall 15 to thereby exerted a predetermined bias against these two wall for sealing thereagainst. The added resistance to urging the first and second pads 32 and 34 created by this additional width can be easily overcome by choosing a Supplemental construction means having sufficient flexible resilient to move the pads 32 and 34 toward one another to create and effective firestopping seal against an penetrating members 11 extending through confinement area 19.

It is important to appreciate that all of the constructions of the present invention provide for a very gentle means of forcibly enhancing the contact between the firestopping pad means 44 and the penetrating cables 11 extending through confinement area 19 within sleeve 10. The flexibly resilient supplemental constriction means 17 and various configurations disclosed herein each will gently urge the firestopping sealing pad means 44 into contact with the external surface of the penetrating cable 11 without creating any abrasion or scraping thereagainst which has heretofore been a problem since such laterally exerted forces can sometimes damage the cables extending therethrough or the outer insulation therearound. The present invention is designed specifically for minimizing any such lateral abrasion or friction against the cables because the firestopping pad is gently constricted thereagainst. Furthermore, the construction of the present invention provides a self-adjusting firestop sleeve which is self-adjusting due to the flexible resilience of the pads themselves and of the flexibly resilient supplemental constriction means 17 which will gently and effectively will form abutting contact and sealing between the firestopping sleeve 10 and penetrating members extending through the confinement area 19 defined therein.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A self-adjusting firestopping sleeve apparatus with a flexibly resilient supplemental constriction means for receiving penetrating members such as wires and cables extending therethrough for firestopping therearound comprising:

A. a sleeve adapted to be positioned passing through a construction barrier wherein said sleeve defines an access corridor extending longitudinally therethrough for providing access through the construction barrier for positioning penetrating members, said sleeve including:
   (1) a first end defining a first opening therein in fluid flow communication with respect to said access corridor;
   (2) a second end defining a second opening therein in fluid flow communication with respect to said access corridor and positioned spatially disposed from said first end;

B. a firestopping pad means located within said access corridor and extending at least partially therealong and defining a confinement area extending longitudinally therethrough along said access corridor for receiving and extending around a penetrating member passing through the confinement area and being responsive to exposure to fire conditions thereadjacent to seal therearound to minimize flow of fire, smoke and heat through said access corridor adjacent the penetrating members, said firestopping pad means being generally circular in cross-section with said confinement area being defined extending axially and longitudinally therethrough, said firestopping pad means includes a plurality of belting loops positioned externally thereon and projecting outwardly therefrom; and C. a supplemental constriction means positioned extending around said firestopping pad means for enhancing constriction thereof around the penetrating member extending through said confinement area thereof to facilitate firestopping sealing therearound, said supplemental constriction means comprising a banding member which is longitudinally resiliently flexible, said banding member being positionable extending through said belting loops to facilitate urging of said firestopping pad means inwardly toward said confinement area to enhance firestopping around penetrating members positioned extending axially therethrough.

2. A self-adjusting firestopping sleeve apparatus as defined in claim 1 wherein said supplemental constriction means is flexibly resilient.

3. A self-adjusting firestopping sleeve apparatus as defined in claim 1 wherein said supplemental constriction means is made of a rubber material.

4. A self-adjusting firestopping sleeve apparatus as defined in claim 1 wherein said supplemental constriction means is positioned extending around said firestopping pad means at a position approximately equidistant between said first opening in said first end and second opening in said second end to facilitate firestopping sealing around a penetrating member positioned extending through said confinement area.

5. A self-adjusting firestopping sleeve apparatus as defined claim 1 wherein said belting loops extend radially outwardly from said firestopping pad means in a direction away from said confinement area and toward said sleeve extending therearound.

6. A self-adjusting firestopping sleeve apparatus as defined in claim 1 wherein said belting loops are positioned approximately equidistant between said first end of said sleeve and said second end of said sleeve to facilitate firestopping sealing around a penetrating member positioned extending through said confinement area.

7. A self-adjusting firestopping sleeve apparatus as defined claim 1 wherein said plurality of belting loops include at least five belt loops.

8. A self-adjusting firestopping sleeve apparatus as defined claim 1 wherein said plurality of belting loops are larger than said banding member to facilitate positioning of said banding member extending therethrough.

9. A self-adjusting firestopping sleeve apparatus as defined claim 1 wherein said firestopping pad means includes an intumescent firestopping material component therewithin.

* * * * *